US006313831B1

(12) United States Patent
Youn et al.

(10) Patent No.: US 6,313,831 B1
(45) Date of Patent: Nov. 6, 2001

(54) DEVICE FOR SYNCHRONIZING A POWER DRIVE SIGNAL OF A MONITOR AND A METHOD THEREFOR

(75) Inventors: Joo-Moon Youn; Chun-Geun Choi, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/343,241

(22) Filed: Jun. 30, 1999

(30) Foreign Application Priority Data

Jun. 30, 1998 (KR) ..... 98-25754
Jul. 31, 1998 (KR) ..... 98-31319

(51) Int. Cl.[7] ..... G09G 5/00

(52) U.S. Cl. ..... 345/204; 345/10; 345/11; 345/12; 345/13; 345/14; 345/204; 345/205; 345/211; 345/213; 315/1; 315/364; 315/370

(58) Field of Search ..... 345/204, 205, 345/10, 11, 12, 13, 14, 211, 213; 315/1, 364, 370

(56) References Cited

U.S. PATENT DOCUMENTS 4,754,330 * 6/1988 Spieth ..... 358/158
5,189,515 * 2/1993 Chen ..... 358/157
6,094,018 * 7/2000 Fujimori et al. ..... 315/370
6,211,855 * 4/2001 Kim ..... 345/127

* cited by examiner

*Primary Examiner*—Richard Hjerpe
*Assistant Examiner*—Jean Lesperance
(74) *Attorney, Agent, or Firm*—Staas & Halsey, LLP

(57) ABSTRACT

A device for synchronizing a power drive signal of a monitor, and a method therefor. The device comprises a central processing unit to receive a horizontal synchronization signal outputted from a video card and to judge whether a frequency of the horizontal synchronization signal is larger than a frequency preset in a memory; a frequency-division circuit to receive the horizontal synchronization signal from the video card and divide the frequency of the horizontal synchronization signal; and a frequency division signal selection circuit to output the frequency-divided horizontal synchronization signal, outputted from the frequency division circuit, to a high voltage drive circuit if the central processing unit judges that the frequency of the horizontal synchronization signal is larger than the preset frequency and to output the horizontal synchronization signal with the frequency thereof unchanged to the high voltage drive circuit if the central processing unit judges that the frequency of the horizontal synchronization signal is not larger than the frequency preset in the memory.

22 Claims, 5 Drawing Sheets

DEVICE FOR SYNCHRONIZING A POWER DRIVE SIGNAL OF A MONITOR AND A METHOD THEREFOR

CROSS-REFERENCE TO RELATED APPLICATIONS

This application claims the benefit of Korean Patent Application Nos. 98-25754 filed Jun. 30, 1998, and 98-31319 filed Jul. 31, 1998 the disclosures of which are incorporated herein by reference.

BACKGROUND OF THE INVENTION

1. Field of the Invention

The present invention relates to a device for synchronizing a power drive signal of a monitor and a method therefor, and more particularly, to a device for synchronizing a power drive signal of a monitor by selectively dividing a frequency of a horizontal synchronization signal and a method therefor.

2. Description of the of Related Art

A frequency division means that a signal with a divided frequency of 1/a (where "a" is positive number) of the original value of the frequency thereof is outputted from a device when the signal with the original value of the frequency is inputted into the device.

For example, when a signal of 50 KHz is inputted into a device and a frequency division of ½ is carried out, a signal of 25 KHz is outputted from the device.

FIG. 1 illustrates a control device of a conventional device for controlling a power drive synchronization signal of a monitor.

A conventional device for controlling power drive synchronization signals of a monitor comprises a micro-computer 72 filtering horizontal / vertical signals (H/V_SYNC) to discern a polarity of signal and calculating a frequency exactly to output a horizontal frequency signal (Hout) and a vertical frequency signal (Vout), a horizontal deflection circuit 74 performing a horizontal deflection function according to the horizontal frequency signal (Hout) outputted from the micro-computer 72, a vertical deflection circuit 76 performing a vertical deflection function according to the vertical frequency signal (Vout) outputted from the micro-computer 72, and a high voltage drive circuit 78 receiving the horizontal frequency signal from the horizontal deflection 74 to output a driving signal driving a high voltage output circuit (not illustrated).

In a monitor provided with the device for controlling the power drive synchronization signal, a power voltage provided to an inner circuit of the monitor is stabilized and a driving signal outputted from a high voltage circuit part to a flyback transformer is synchronized with a horizontal synchronization signal applied from a video card to a horizontal circuit part.

However, in a conventional device for controlling power drive synchronization signal as described above, the flyback transformer should be operated by a period of high frequency when the horizontal synchronization signal has a high frequency. Accordingly, a lot of power loss occurs due to the flyback transformer. In addition, as electronic parts for high current are required, high power voltage should be connected to the flyback transformer to support the movement of said flyback transformer, cost for such devices are increased.

SUMMARY OF THE INVENTION

Accordingly, in order to overcome such drawbacks in the conventional art, it is therefore an object of the present invention to provide a device for synchronizing a power drive signal of a monitor by dividing a frequency of a horizontal synchronization signal so as to reduce a power loss of such a product and a cost of production and simplify a method therefor.

Additional objects and advantages of the invention will be set forth in part in the description which follows and, in part, will be obvious from the description, or may be learned by practice of the invention.

To achieve the above and other objects, in accordance with the present invention, there is provided a device for synchronizing a power drive signal of a monitor, the device comprising a central processing unit to receive a horizontal synchronization signal outputted from a video card and judge whether a frequency of the horizontal synchronization signal is larger than a frequency preset in a memory; a frequency-division circuit to receive the horizontal synchronization signal from the video card and divide the frequency of the horizontal synchronization signal; a high voltage driving circuit to generate the power drive signal; and a frequency division signal selection circuit to output the frequency-divided horizontal signal synchronization from the frequency division circuit to the high voltage driving circuit in response to the central processing unit judging that the frequency of the horizontal synchronization signal is larger than the preset frequency and outputting the horizontal synchronization signal with the frequency thereof unchanged to the high voltage drive circuit in response to the central processing unit judging that the frequency of the horizontal synchronization signal is not larger than the frequency preset in the memory.

To further achieve the above and other objects of the present invention, there is provided a method of controlling a device for synchronizing a power drive signal of a monitor, the method comprising receiving a horizontal synchronization signal from a video card and determining a frequency of the horizontal synchronization signal; judging whether the frequency of the horizontal synchronization signal is larger than a frequency preset in a memory; dividing the frequency of the horizontal synchronization signal and driving a high voltage driving circuit by the frequency-divided horizontal synchronization signal in response to the judgement that the frequency of the horizontal synchronization signal is larger than the frequency preset in the memory in the judging step.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DESCRIPTION OF THE PREFERRED EMBODIMENT

The embodiment of the present invention will be apparent from the following description in conjunction with the accompanying drawings.

Figure 1:
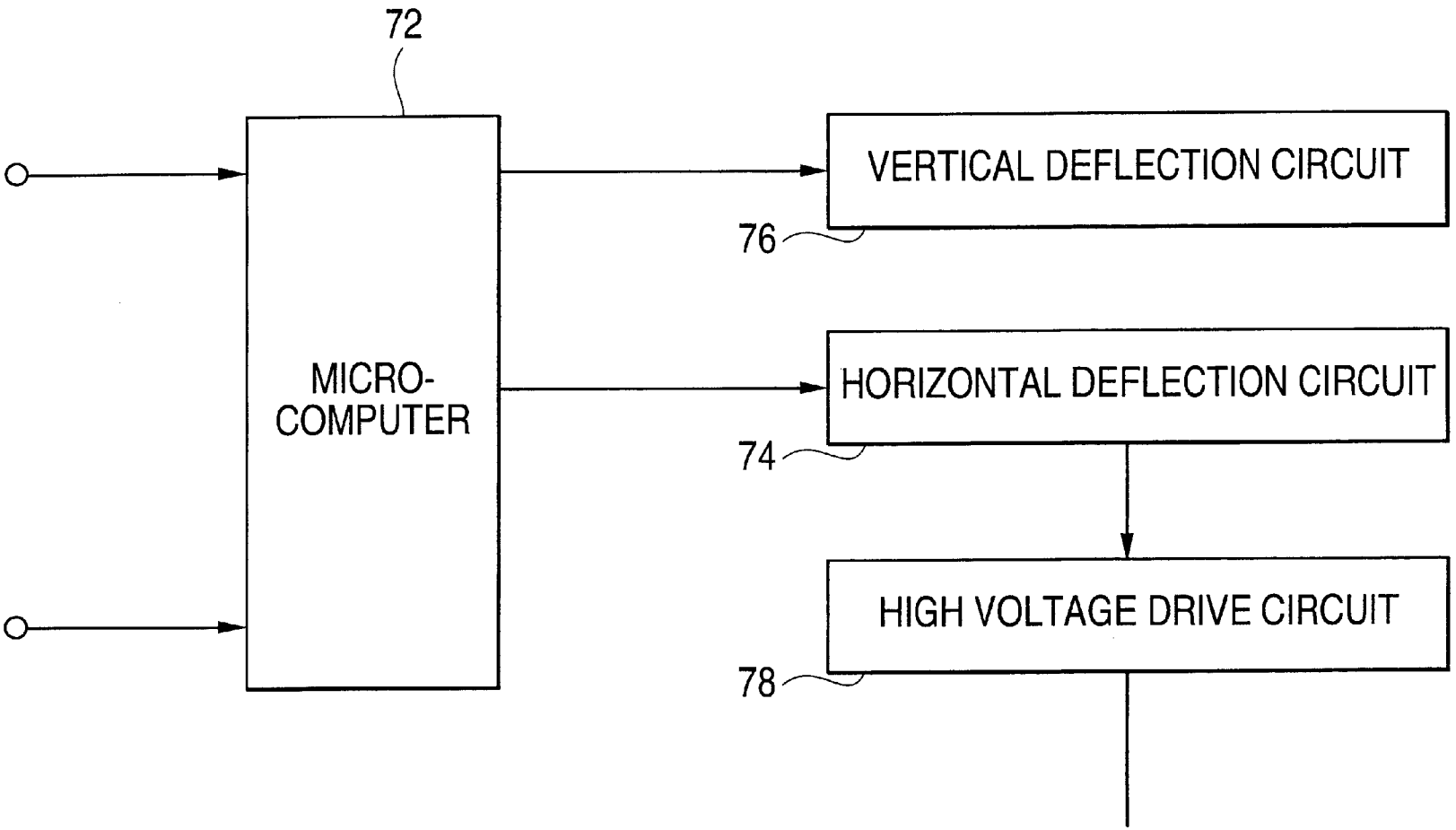
FIG. 1 (PRIOR ART)
FIG. 1 is a block diagram of a control circuit of a conventional device for controlling a power drive synchronization signal of a monitor.
Figure 2:
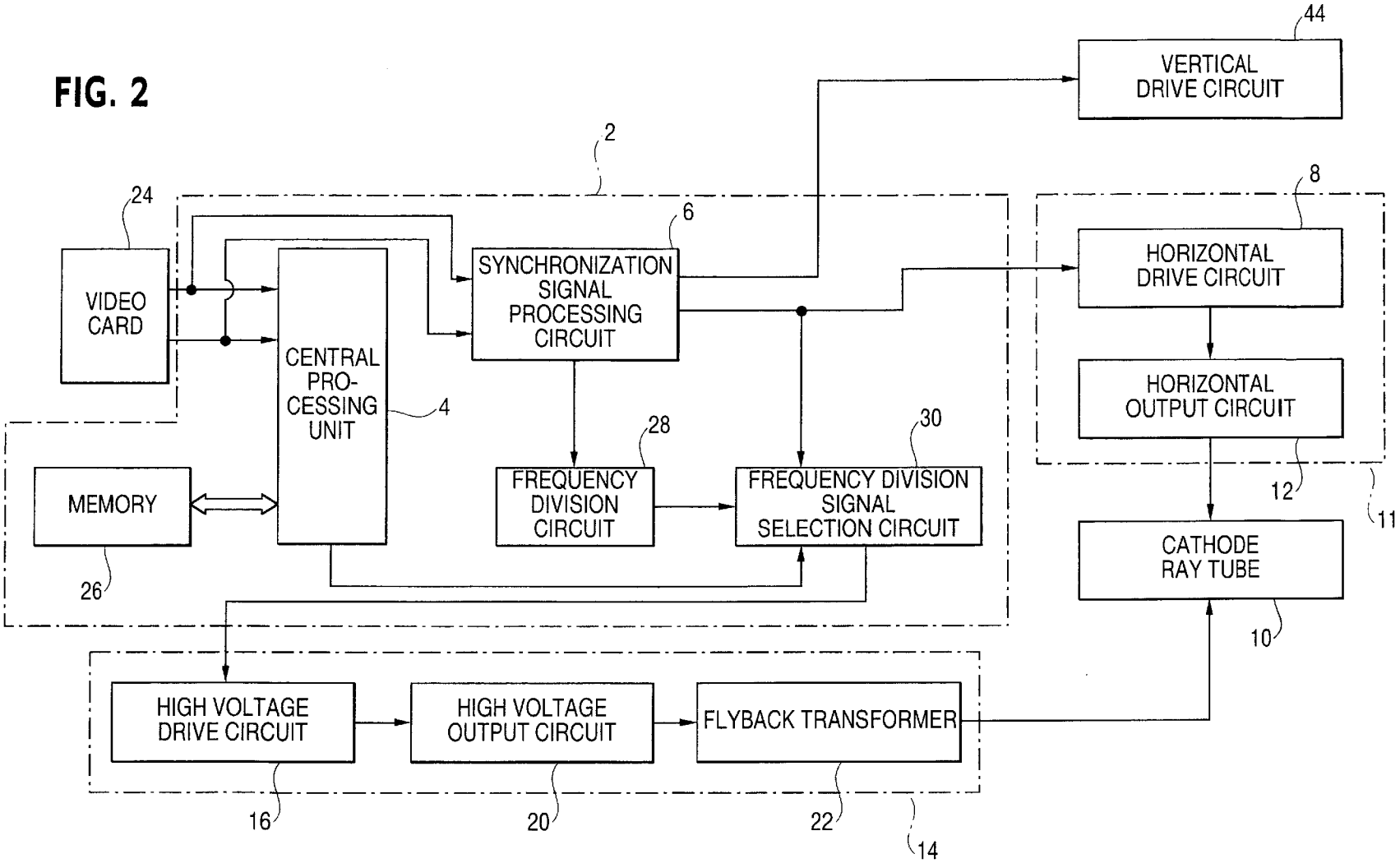
FIG. 2 is a block diagram of a control circuit of a monitor provided with a device for controlling a power drive synchronization signal according to an embodiment of the present invention.

FIG. 2 is a block view of a control circuit of a monitor provided with a device for controlling a power drive synchronization signal according to an embodiment of the present invention.

A micro-computer 2 controlling a device for controlling a power drive synchronization signal of a monitor according to the embodiment of the present invention comprises a memory 26 memorizing a setting frequency about a horizontal synchronization signal, a CPU (central processing unit) 4 receiving the horizontal synchronization signal outputted from a video card 24 to discern whether a frequency of the horizontal synchronization signal is larger than the setting frequency preset in the memory 26, a synchronization signal processing circuit 6 receiving the horizontal synchronization signal and a vertical synchronization signal from the video card 24 to detect the horizontal synchronization signal and the vertical synchronization signal, respectively, and to discern a synchronous polarity of the horizontal synchronization signal and the vertical synchronization signal, a frequency division circuit 28 receiving the horizontal synchronization signal from the synchronization signal processing circuit 6 and dividing a frequency of the horizontal synchronization signal to output a horizontal synchronization signal having a divided frequency, and a frequency division signal selection circuit 30 selectively selecting the frequency-divided horizontal synchronization signal from the frequency division circuit 28.

The frequency division signal selection circuit 30 is connected to the synchronization signal processing circuit 6 and the central processing unit 4, to output the frequency-divided horizontal synchronization signal, outputted from the frequency division circuit 28, to a high voltage drive circuit 16 when the central processing unit 4 judges that the frequency of the horizontal synchronization signal is larger than the preset setting frequency. The frequency division signal selection circuit 30 outputs the horizontal synchronization signal to the high voltage drive circuit 16 in such state that the frequency of the horizontal synchronization signal outputted from the video card 24 remains as it is when the central processing unit 4 judges that the frequency of the horizontal synchronization signal is not larger than the setting frequency preset in the memory 26.

A horizontal circuit part 11 applying a horizontal voltage to a cathode ray tube 10 includes a horizontal drive circuit 8 receiving the horizontal synchronization signal from the synchronization signal processing circuit 6, to output a first driving signal, and a horizontal output circuit 12 outputting the horizontal voltage to the cathode ray tube 10 in response to receiving the first driving signal from the horizontal drive circuit 8, thereby deflecting an electron beam from the cathode ray tube 10 in a horizontal direction.

A high voltage circuit part 14 receives the horizontal synchronization signal or the frequency-divided horizontal synchronization signal from the frequency-division signal selection circuit 30 to output a high voltage pulse synchronized with the horizontal synchronization signal. The high voltage circuit part 14 includes a high voltage drive circuit 16 receiving the horizontal synchronization signal or the frequency-divided horizontal synchronization signal from the frequency-division signal selection circuit 30 to output a second driving signal synchronized with the horizontal synchronization signal, a high voltage output circuit 20 receiving a direct current voltage outputted from a direct current voltage output circuit (not shown) to output a high alternating current voltage by being switched according to the second driving signal outputted from the high voltage driving circuit 16, and a flyback transformer 22 receiving the high alternating current voltage outputted from the high voltage output circuit 20 to output a high voltage pulse to the cathode ray tube 10.

The frequency-division signal selection circuit 30 is a multiplexer receiving the horizontal synchronization signal with a normal frequency from the video card 24 and receiving the frequency-divided horizontal synchronization signal from the frequency-division circuit 28 to output one signal, formed of the horizontal synchronization signal with the normal frequency and the frequency-divided horizontal synchronization signal according to a selection signal outputted from the central processing unit 4, to the high voltage drive circuit 16.

Figure 3:
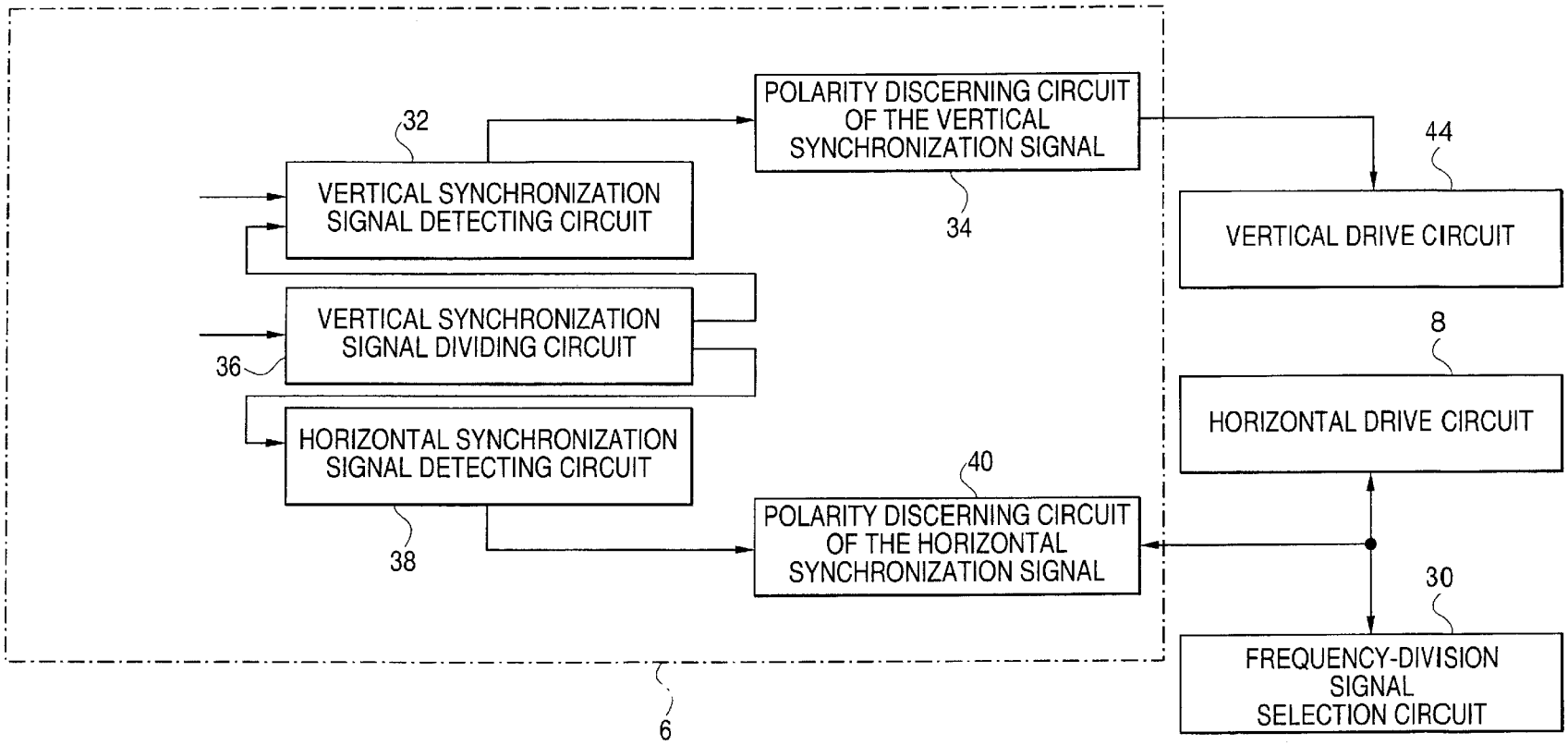
FIG. 3 is a block view of a concrete control circuit of a synchronization signal processing circuit illustrated in FIG. 2.

As shown in FIG. 3, the synchronization signal processing circuit 6 includes a vertical synchronization signal detecting circuit 32 to receive the vertical synchronization signal outputted from the video card 24, a polarity discerning circuit of the vertical synchronization signal 34 judging whether a polarity of the vertical synchronization signal outputted from the vertical synchronization signal detecting circuit 32 is active high or low, a vertical synchronization signal dividing circuit 36 to divide the vertical synchronization signal and the horizontal synchronization signal from a complex signal when the complex signal of the vertical synchronization signal and the horizontal synchronization signal is outputted from the video card 24, a horizontal synchronization signal detecting circuit 38 to detect the horizontal synchronization signal outputted from the vertical synchronization signal dividing circuit 36, and a polarity discerning circuit of the horizontal synchronization signal 40 judging whether a polarity of the horizontal synchronization signal outputted from the horizontal synchronization signal detecting circuit 38 is active high or low.

Figure 4:
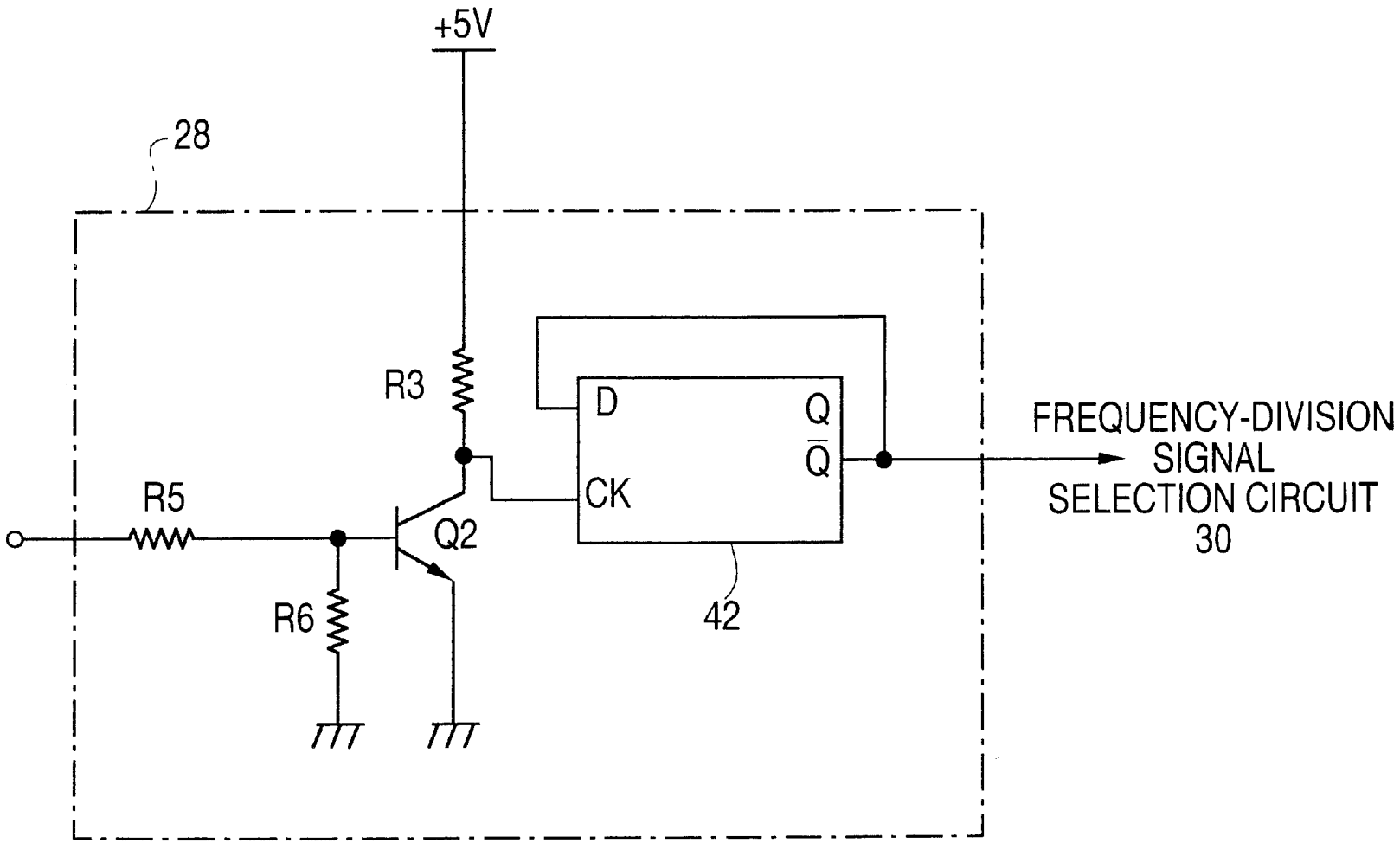
FIG. 4 is a circuit diagram of a frequency-division circuit illustrated in FIG. 2.

As shown in FIG. 4, the frequency-division circuit 28 comprises a transistor Q2 being switched according to the horizontal synchronization signal outputted from the polarity discerning circuit of the horizontal synchronization signal 40 within the synchronization signal processing circuit 6 and a D-flip-flop 42 receiving the horizontal synchronization signal outputted from the transistor Q2 as a clock signal to output ½ the frequency of the horizontal synchronization signal to the frequency-division signal selection circuit 30. A resistor R5 has one end which receives the horizontal synchronization signal from the polarity discerning circuit of the horizontal synchronization signal 40 and another end connected to a base of the transistor Q2. A resistor R6 has one end connected to the base of the transistor Q2 and the other end connected to ground. A resistor R3 has one end connected to a collector of the transistor Q2 and the other end connected to a 5V source. The emitter of the transistor Q2 is connected to ground.

The method for controlling the device for controlling the power drive synchronization signal of a monitor according to the embodiment of the present invention will be apparent from the following description in conjunction with the device for controlling the power drive synchronization signal of the monitor according to the embodiment of the present invention.

Figure 5:
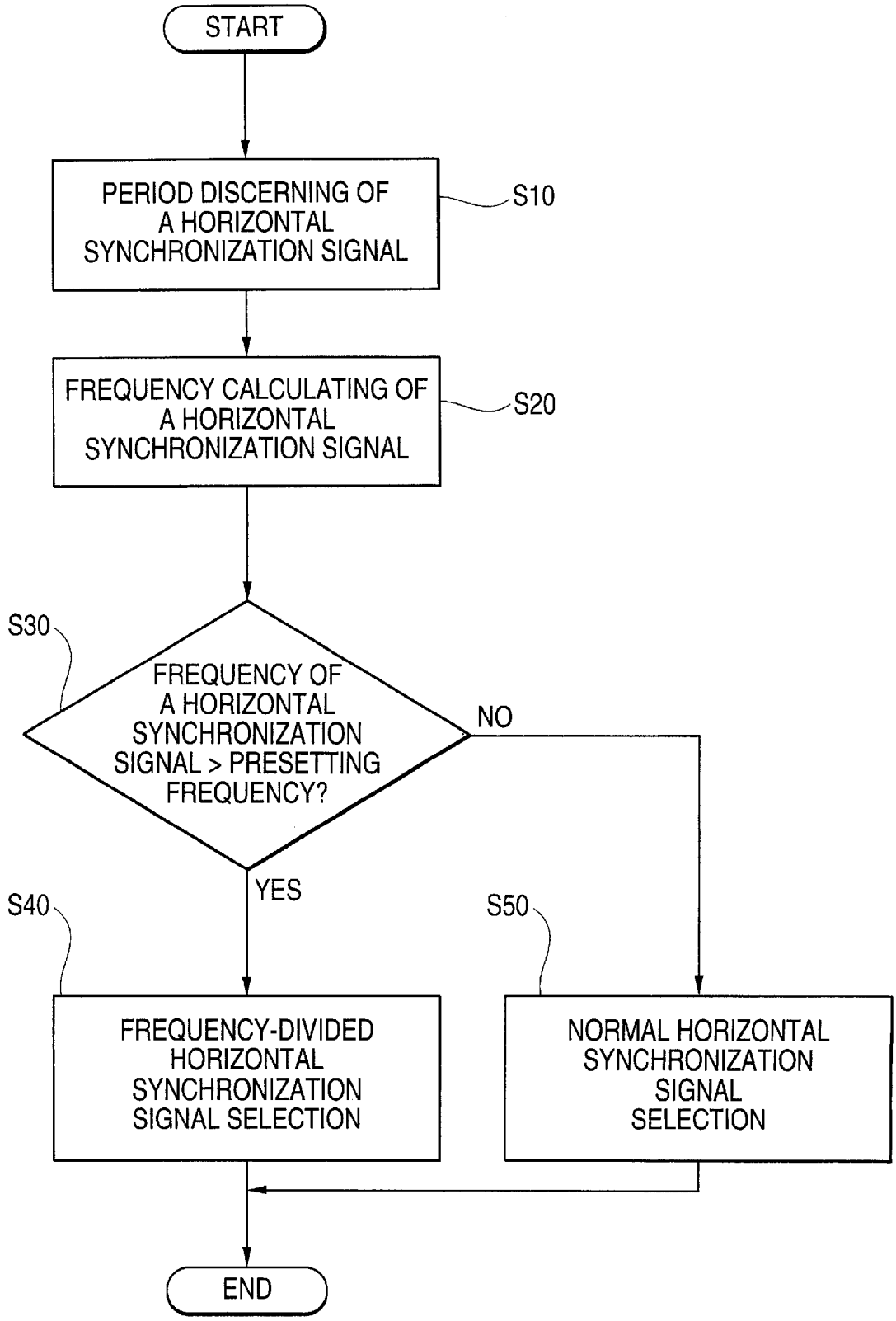
FIG. 5 is a flow chart of a method of controlling a device for controlling a power drive synchronization signal according to the embodiment of the present invention.

FIG. 5 is a flow chart of a method of controlling a device for controlling a power drive synchronization signal, wherein "S" stands for "an operation."

First, a vertical synchronization signal is outputted from the video card 24 to the central processing unit 4 and the vertical synchronization signal detecting circuit 32 of the synchronization signal processing circuit 6.

At the same time, a horizontal synchronization signal is outputted from the video card 24 to the central processing unit 4 and the vertical synchronization signal dividing circuit 36.

Next, the horizontal synchronization signal is outputted from the vertical synchronization signal dividing circuit 36 to the horizontal synchronization signal detecting circuit 38.

Then, the horizontal synchronization signal is outputted from the horizontal synchronization signal detecting circuit 38 to the polarity discerning circuit of the horizontal synchronization signal 40.

Next, the horizontal synchronization signal is outputted from the polarity discerning circuit of the horizontal synchronization signal 40 to the frequency-division circuit 28 at the same time that the horizontal synchronization signal is outputted from the polarity discerning circuit of the horizontal synchronization signal 40 to the horizontal drive circuit 8.

Then, the horizontal synchronization signal is frequency-divided in the frequency-division circuit 28. The frequency-divided horizontal synchronization signal with ½ the frequency of the horizontal synchronization signal is outputted from the frequency-division circuit 28. For example, the horizontal synchronization signal of 30 KHz is outputted from the frequency-division circuit 28 to the frequency-division signal selection circuit 30 when the horizontal synchronization signal of 60 Khz is inputted from the polarity discerning circuit of the horizontal synchronization signal 40 to the frequency-division circuit 28.

At the same time, the horizontal synchronization signal is outputted from the polarity discerning circuit of the horizontal synchronization signal 40 to the frequency-division signal selection circuit 30.

Meanwhile, the central processing unit 4 in operation S10 calculates a period of the horizontal synchronization signal inputted from the video card 24.

Next, a reciprocal amount of the period of the horizontal synchronization signal is calculated in operation S20 to calculate the frequency of the horizontal synchronization signal.

Then, the central processing unit 4 in operation S30 judges whether the frequency of the horizontal synchronization signal is larger than the frequency preset in the memory 26. For example, the frequency preset in the memory 26 is 50 Khz.

Here, when it is judged that the frequency of the horizontal synchronization signal is larger than the frequency preset in the memory 26 (in case of yes), the process goes to operation 40 as the frequency of the horizontal synchronization signal should be divided to prevent a noise on a picture.

A frequency-division selection signal in operation S40 is outputted from the CPU 4 to the frequency-division signal selection circuit 30 to select the frequency-divided horizontal synchronization signal outputted from the frequency-division circuit 28.

Then, the frequency-division signal selection circuit 30 selects the frequency-divided horizontal synchronization signal from the frequency-division circuit 28 instead of the horizontal synchronization signal inputted from the polarity discerning circuit of the horizontal synchronization signal 40.

Next, the frequency-divided horizontal synchronization signal from the frequency-division signal selection circuit 30 is inputted to the high voltage drive circuit 16.

Then, the high voltage drive circuit 16 is switched in accordance with the frequency synchronized with the horizontal synchronization frequency inputted from the frequency-division signal selection circuit 30, to output the second driving signal.

Next, the second driving signal is outputted from the high voltage drive circuit 16 to the high voltage output circuit 20 and is synchronized with the horizontal synchronization frequency.

Then, the high voltage of alternating current is outputted from the high voltage output circuit 20 to the flyback transformer 22.

Next, a high voltage pulse synchronized with the horizontal synchronization signal is outputted from the flyback transformer 22 to the cathode ray tube 10.

In the meantime, the horizontal synchronization signal is outputted from the polarity discerning circuit of the horizontal synchronization signal 40 to the horizontal driving circuit 8 at the same time as the horizontal synchronization signal is outputted from the polarity discerning circuit of the horizontal synchronization signal 40 to the frequency-division circuit 28, to generate the first driving signal.

Then, the first driving signal is outputted from the horizontal driving circuit 8 to the horizontal output circuit 12. Next, the horizontal voltage is applied from the horizontal output circuit 12 to the cathode ray tube.

Meanwhile, when the vertical synchronization signal is outputted from the video card 24 to the vertical synchronization signal detecting circuit 32, the vertical synchronization signal is detected in the vertical synchronization signal detecting circuit 32.

Then, the vertical synchronization signal is outputted from the vertical synchronization signal detecting circuit 32 to the polarity discerning circuit of the vertical synchronization signal 34.

Next, the vertical synchronization signal is outputted from the polarity discerning circuit of the vertical synchronization signal 34 to a vertical drive circuit 44.

In the meantime, when it is judged that the frequency of the horizontal synchronization signal in operation S30 is not larger than the frequency preset in the memory 26 (in case of no), the normal horizontal synchronization selection signal is outputted from the central processing unit 4 to the frequency-division signal selection circuit 30 in operation S50.

Then, the frequency-division signal selection circuit 30 selects the horizontal synchronization signal inputted from the polarity discerning circuit of the horizontal synchronization signal 40 instead of the frequency-divided horizontal synchronization signal inputted from the frequency-division circuit 28.

Then, the horizontal synchronization signal with the normal frequency is outputted from the frequency-division signal selection circuit 30 to the high voltage driving circuit 16. The high voltage drive circuit 16, the high voltage output circuit 20 and the flyback transformer 22 process the horizontal synchronization signal with the normal (unchanged) frequency in a same fashion as these elements process the frequency-divided horizontal synchronization signal output from the frequency-division signal selection circuit 30.

As described above, the output circuit shown in FIG. 2 can output the high voltage synchronized with the horizontal synchronization signal having the high frequency from the flyback transformer using the frequency-division circuit and the frequency-division signal selection circuit 30 constructed within the micro-computer. In addition, the high voltage, synchronized with the horizontal synchronization signal having the high frequency, can be outputted from the flyback transformer by a simple construction.

Further, when the horizontal synchronization signal has the high frequency, the horizontal synchronization signal is frequency-divided and the horizontal synchronization signal with this divided frequency synchronizes the driving signal of the high voltage drive circuit. Therefore, as auxiliary electronic parts for the high frequency are not required, the production cost can be reduced and the design of the products can be simply made.

Meanwhile, the method of controlling the device for controlling a power drive synchronization signal according to the present invention makes a frequency-division of the horizontal synchronization signal when the horizontal synchronization signal has a high frequency, and synchronizes the driving signal of the high voltage drive circuit by the horizontal synchronization signal with this frequency-divided frequency.

Accordingly, the noise on the picture can be prevented without using any auxiliary electronic parts for the high frequency.

It will be apparent to those skilled in the art that various modifications can be made in the present invention, without departing from the spirit of the invention. Thus, it is intended that the present invention cover such modifications as well as variations thereof, within the scope of the appended claims and their equivalents.

What is claimed is:

1. A device for synchronizing a power drive signal of a monitor in accordance with a horizontal synchronization signal from a video card, the device comprising:

a central processing unit to receive the horizontal synchronization signal from the video card and determine whether a frequency of the horizontal synchronization signal is larger than a preset frequency;

a frequency-division circuit to receive the horizontal synchronization signal from the video card and divide the frequency of the horizontal synchronization signal, to generate a frequency-divided horizontal synchronization signal;

a high voltage drive circuit to generate the power drive signal to the monitor in response to an input signal; and a frequency-division signal selection circuit to output the frequency-divided horizontal synchronization signal from said frequency-division circuit to said high voltage drive circuit as the input signal in response to said central processing unit determining that the frequency of the horizontal synchronization signal is larger than the preset frequency, and output the horizontal synchronization signal to the high voltage drive circuit as the input signal in response to said central processing unit determining that the frequency of the horizontal synchronization signal is not larger than the preset frequency.

2. The device as claimed in claim 1, wherein said frequency-division circuit comprises a D flip-flop to receive the horizontal synchronization signal from the video card, and to output the frequency-divided horizontal synchronization signal with ½ the frequency of the horizontal synchronization signal.

3. The device as claimed in claim 1, wherein said frequency-division signal selection circuit comprises a multiplexer to receive and selectively transmit the horizontal synchronization signal and the frequency-divided horizontal synchronization signal as the input signal to the high voltage driving circuit according to the determination of the central processing unit.

4. A method of controlling a device for synchronizing a power drive signal of a monitor, the method comprising:

receiving a horizontal synchronization signal and determining a frequency of the horizontal synchronization signal;

judging whether the frequency of the horizontal synchronization signal is larger than a preset frequency;

dividing the frequency of the horizontal synchronization signal and driving a high voltage driving circuit by the frequency-divided horizontal synchronization signal in response to the judgment being that the frequency of the horizontal synchronization signal is larger than the preset frequency.

5. The method as claimed in claim 4, further comprising driving the high voltage driving circuit by the horizontal synchronization signal in response to the judgment that the frequency of the horizontal synchronization signal is not larger than the preset frequency.

6. The method as claimed in claim 4, wherein the step of dividing the frequency of the horizontal synchronization signal comprises dividing the frequency of the horizontal synchronization signal by 2.

7. The method as claimed in claim 4, further comprising:

dividing the horizontal synchronization signal and a vertical synchronization signal from a complex signal; and judging whether a polarity of the horizontal synchronization signal is active high or low, prior to frequency-dividing the horizontal synchronization signal.

8. The method as claimed in claim 5, further comprising:

generating a drive signal in accordance with the frequency-divided horizontal synchronization signal and the horizontal synchronization signal;

converting a direct current voltage to an alternating current voltage in accordance with the drive signal; and generating the power drive signal in accordance with the alternating current voltage.

9. A method of controlling a device for synchronizing a power drive signal of a monitor, the method comprising:

receiving a horizontal synchronization signal from a video card and determining a frequency of the horizontal synchronization signal;

judging whether the frequency of the horizontal synchronization signal is larger than a preset frequency;

reducing the frequency of the horizontal synchronization signal and driving a high voltage driving circuit by the frequency-reduced horizontal synchronization signal in response to the judgment being that the frequency of the horizontal synchronization signal is larger than the preset frequency.

10. A device for synchronizing a power drive signal of a monitor in accordance with a horizontal synchronization signal, comprising:

a processing element to determine whether the horizontal synchronization signal has a frequency greater than a preset frequency;

a frequency output circuit to reduce the frequency of the horizontal synchronization signal and selectively output the reduced-frequency horizontal synchronization signal as an input signal if the frequency of the horizontal synchronization signal is greater than the preset frequency; and a voltage drive circuit to generate and transmit the power drive signal to the monitor in response to the input signal.

11. The device as claimed in claim 10, wherein:

said processing element generates a selection signal in accordance with the determination; and said frequency output circuit comprises a frequency-division circuit to reduce the frequency of the horizontal synchronization signal by dividing the frequency of the horizontal synchronization signal to generate a frequency-divided horizontal synchronization signal, and a frequency-division signal selection circuit to selectively output the frequency-divided horizontal synchronization signal and the horizontal synchronization signal as the input signal in accordance with the selection signal.

12. The device as claimed in claim 10, further comprising:

a memory to store the preset frequency.

13. The device as claimed in claim 11, further comprising:

a memory to store the preset frequency.

14. The device as claimed in claim 11, further comprising a synchronization signal processing circuit to divide the horizontal synchronization signal from a complex signal including the horizontal synchronization signal and a vertical synchronization signal and transmitting the horizontal synchronization signal to said frequency-division circuit and said frequency-division signal selection circuit.

15. The device as claimed in claim 14, wherein said synchronization signal processing circuit comprises:

a vertical synchronization signal dividing circuit to divide the horizontal synchronization signal and the vertical synchronization signal from the complex signal;

a horizontal synchronization signal detecting circuit to detect the horizontal synchronization signal from said vertical synchronization signal dividing circuit;

a first polarity discerning circuit to judge whether a polarity of the horizontal synchronization signal from said horizontal synchronization signal detecting circuit is active high or low, and to transmit the horizontal synchronization signal to said frequency-division circuit and said frequency-division signal selection circuit.

16. The device as claimed in claim 15, wherein:

a vertical drive circuit to drive the monitor by vertical control; and said synchronization signal processing circuit further comprises a vertical synchronization signal detecting circuit to detect the vertical synchronization signal from said vertical synchronization signal dividing circuit, and a second polarity discerning circuit to judge whether a polarity of the vertical synchronization signal from said vertical synchronization signal detecting circuit is active high or low, and to transmit the vertical synchronization signal to said vertical drive circuit.

17. The device as claimed in claim 10, wherein said voltage drive circuit comprises:

a high voltage drive circuit to generate a drive signal in response to the input signal;

a high voltage output circuit to convert a direct current voltage to an alternating current voltage in accordance with the drive signal; and a flyback transformer to output a high voltage pulse as the power drive signal to the monitor in accordance with the alternating current voltage.

18. The device as claimed in claim 11, wherein said voltage drive circuit comprises:

a high voltage drive circuit to generate a drive signal in response to the input signal;

a high voltage output circuit to convert a direct current voltage to an alternating current voltage in accordance with the drive signal; and a flyback transformer to output a high voltage pulse as the power drive signal to the monitor in accordance with the alternating current voltage.

19. The device as claimed in claim 14, wherein said voltage drive circuit comprises:

a high voltage drive circuit to generate a drive signal in response to the input signal;

a high voltage output circuit to convert a direct current voltage to an alternating current voltage in accordance with the drive signal; and a flyback transformer to output a high voltage pulse as the power drive signal to the monitor in accordance with the alternating current voltage.

20. The device as claimed in claim 11, wherein said frequency-division circuit comprises:

a D flip-flop to frequency divide the horizontal synchronization frequency.

21. The device as claimed in claim 11, wherein said frequency-division circuit further comprises a transistor having a base to receive the horizontal synchronization signal, a collector connected through a resistor to a first predetermined voltage, and an emitter to receive a second predetermined voltage, wherein said D lip-flop divides the frequency of the horizontal synchronization signal by 2.

22. The device as claimed in claim 8, further comprising a micro-computer which includes said processing element, said frequency-division circuit and said frequency-division signal selection circuit.

* * * * *